United States Patent [19]

Zeldman

[11] Patent Number: 4,746,894

[45] Date of Patent: May 24, 1988

[54] METHOD AND APPARATUS FOR SENSING POSITION OF CONTACT ALONG AN ELONGATED MEMBER

[76] Inventor: Maurice Zeldman, 1401 Pueblo Dr., Pittsburgh, Pa. 15228

[21] Appl. No.: 820,385

[22] Filed: Jan. 21, 1986

[51] Int. Cl.[4] ..... H01C 10/10

[52] U.S. Cl. ..... 338/99; 338/114; 901/33; 414/5

[58] Field of Search ..... 338/99, 47, 92, 93, 338/95, 114; 901/36, 33, 46; 73/862.55, 862.62; 414/5

[56] References Cited

U.S. PATENT DOCUMENTS

| | | | |
|---|---|---|---|
| 2,586,544 | 2/1952 | Kesselfing | 338/95 |
| 2,887,552 | 5/1959 | Lustig et al. | 338/95 X |
| 3,613,042 | 10/1971 | Leerkamp et al. | 338/95 X |
| 4,208,643 | 6/1980 | Naumann | 338/99 |
| 4,492,949 | 1/1985 | Peterson et al. | 338/99 X |
| 4,493,219 | 1/1985 | Sharp et al. | 338/99 X |
| 4,555,954 | 12/1985 | Kim | 338/99 X |

*Primary Examiner*—E. A. Goldberg
*Assistant Examiner*—M. M. Lateef

[57] ABSTRACT

Objects contacted by mechanical fingers cause shunts that are touched at a position to contact resistance strips. Sensing resistance remaining between the shunt contact and one end of the resistance strip indicates position of contact along the finger. Shapes and alignments of objects are sensed by comparing positional information along several fingers.

23 Claims, 7 Drawing Sheets

METHOD AND APPARATUS FOR SENSING POSITION OF CONTACT ALONG AN ELONGATED MEMBER

BACKGROUND OF THE INVENTION

Positional contact sensing hands or devices are needed in robots, manipulators, and automation equipment to provide tactile information or artificial intelligence data for optimization of these devices. Such sensing is required to enable a machine to recognize: the orientation and special properties of an object that is about to be grasped: the special properties of an object already grasped: or how the object was grasped. When objects are provided to the tactile system on a random basis, the system should be able to recognize which object of a set of objects was grasped.

While many problems remain in the creation of artificial intelligence apparatus, one of the most compelling problems that remains is the sensing of article positions and orientations by mechanisms, grippers, end effectors or hands.

Examples of prior art in this general art area are as follows:

U.S. Pat. Nos.:
3,418,850
2,388,966
2,435,254
2,508,419
2,695,518
3,024,648
3,093,806.

Periodicals:

"Inside a Robotics Lab: The Quest for Automatic Touch", Technology Illustrated, p. 23, Apr. 22, 1983.

A. K. Bejczy, "AIAA/NASA Conference on 'Smart' Sensors", American Institute of Aeronautics and Astronautics, pp. 1–17, Nov. 14–16, 1978.

William Daniel Hillis, "Active Touch Sensing", Massachusetts Institute of Technology, A.I. Memo 629, pp. 1–37, April 1981.

Prof. Leon D. Harmon, "A Sense of Touch Begins to Gather Momentum", Sensor Review, April 1981.

Arthur C. Sanderson and George Perry, "Sensor-Based Robotic Assembly Systems: Research and Applications in Electronic Manufacturing", Proceedings of the IEEE, Vol. 71, No. 7, pp. 856–871, July, 1983.

This invention advances solutions of the remaining problems.

SUMMARY OF THE INVENTION

Objects contacted by mechanical fingers push shunts and resistance strips into contact at the positions where the shunts are touched. Sensing resistance remaining between the shunt contact and one end of the resistance strip indicates position of contact along the finger. Strips and alignments of objects are sensed by comparing positional information along several fingers.

At the heart of the present artificially intelligent sensing system is a special touch potentiometer. This invention develops sophisticated information by use of a simple sensing system.

Each digit of the intelligent hand is equipped with a touch potentiometer. The simplest form may be a single finger and a palm, but "n" fingers or digits are possible depending on the application. When the intelligent hand touches an object, signals are produced in each digit. These signals form a pattern which is the result of the object's shape. This pattern can be compared with one stored in memory.

If an object is to be grasped in a specific manner, the hand can be moved by a robot or servo-mechanism to "feel" until it obtains a specific pattern. It then grasps the object correctly. This is a grope mode.

By comparing an object against a series of stored patterns, object or pattern recognition is possible.

This will become clear as we look at the embodiment of the invention. An artificially intelligent hand and gripping system. A hand that can sense position, shape, and when equipped with additional sensors, the hardness or weight of an object, and the temperature of the object.

The preserved intelligent hand apparatus comprises a palm and plural fingers extending from the palm, the palm and the fingers having outside and inside surfaces and touch positional sensing means on the inside of the fingers. The touch positional sensing means comprises a resistance element extending along the inside of each finger and shunting means extending generally parallel to the resistance element along each finger and resilient means resiliently separating the shunting means and the resistance element on each finger. A source of electrical potential is connected to opposite ends of each resistance element. Resistance sensing means is connected to one end of each resistance element and to the shunt for sensing resistance of the resistance element between the one end of the resistance element and the contact or the shunt for determining position of contact of the shunt on the resistance element and for determining point of pressure on the finger on which the resistance element and shunt are mounted and position on the palms if resistance elements are included in it. In a preserved embodiment an elongated insulator is connected to each finger. The resistance element is mounted on the insulator and the resilient means comprises parallel elastomeric pads positioned beside the insulator and extending outward from the finger beyond the insulator. The shunt means is a conductive strip connected to the elastomeric pads outward from the insulator and spaced from the resistance element and moveable into contact with a portion of the resistance element by compression of a portion of the elastomeric pads by pressure placed upon the conductor strip.

In one embodiment the shunting element extends back and forth transversely across the supporting finger as it extends outward along the finger, with a series of substantially long transversely extending conductive portions interconnected at opposite ends thereof by relatively short longitudinally extending resistance portions. As this shunt means contacts successive relatively long longitudinally extending portions of the resistance element, the sensing means senses stepped changes in potential, thus digitizing the signal of the sensor means.

In one embodiment longitudinally extending portions of a resistance element, an inversion of the shunting element, become successively shorter as the resistance element proceeds from one end of the supporting finger to a second end of the supporting finger. In that embodiment each finger is tapered with a relatively large first end connected to a palm and a relatively small second end spaced from a palm. This embodiment can be used for increased sensitivity at a specific section of the finger. In another embodiment the transversely extending portions of the resistance element are substantially equal in length along the entire surface of the finger, producing digital linear signals.

In one embodiment one end of the shunt means is electrically connected to one end of the resistance means, and the sensing is based on current flow. In another embodiment the sensing means, the shunt, contacts the resistance element which is connected to a potential. Position is sensed as a voltage difference, the way a potentiometer works.

In one form the resilient means comprises an elongated elastomeric strip having a central portion for holding the resistance element and having upward extended lateral portions for holding the shunt means. One elastomeric strip further comprises a base portion and column portions extending upward on opposite sides of the resistance element for supporting the shunt means spaced from the resistance element until the shunt means encounters an object. One elastomeric strip comprises block-like lateral portions surrounding a block-like central portion. The resistance element is placed on the block-like central portion. The shunt means comprises a conductive planar element supported on the block-like outer portions of the elastomeric strip.

In one embodiment the resistance element is grounded at opposite ends. The source of potential is applied to one end of the shunt means and the sensing means senses drop on potential according to position of grounding of the shunt means on the resistance element.

In another embodiment second shunt means is substantially parallel to the first shunt means, the second shunt means having potential upon to one end thereof which is opposite to the end of the first shunt means on which potential is applied.

In one embodiment the resistance element comprises a first resistance element having a potential applied at one end thereof and a second opposite resistance element. The sensing means senses positional contact of the shunt means from opposite ends of the supporting finger.

One resistance element comprises a resistance strip longitudinally extended along the supporting finger, the resilient means comprises first and second parallel elastomeric strips extending along opposite lateral edges of the resistance strip, and the shunt means comprises a flexible metal strip positioned on the elastomeric strips.

One flexible metal shunt strip comprises a comb-like strip, continuous along one lateral edge and discontinuous along the opposite lateral edge. This is an alternate means of producing digital signals.

In one embodiment the resilient means is mounted above and below the resistance element and the shunt means comprises upper shunt means connected to the resilient means and lower shunt means connected to the resilient means on opposite sides of the resistance element whereby the sensing means senses positional contact of either shunt means or the resistance element on either side of the resistance element. This provides top and bottom contact or area contact.

A preferred resistance element comprises a relative rigid conductor and the resilient means comprises a domed resilient strip connected to the rigid conductor and the shunt means is mounted inside the domed resilient strip.

A preferred touch position sensing finger apparatus comprises a palm mounted for movement, a finger mounted on the palm for movement with respect to the palm and touch positional sensing means mounted on at least one side of the finger for sensing position along the finger at which a relatively stationary object is encountered and touched by the finger, the sensing means comprising a resistance element extending along the finger and a shunt means extending along the finger parallel to the resistance element and resilient insulating means extending along the finger and spacing the shunt means and the resistance element until a relatively stationary object is encountered and touched and further comprising potential means connected to one of the resistance element and shunt means and potential sensing means connected to one of the resistance element and shunt means for sensing potential drop associated within a portion of the resistance element remaining unshunted after contact of the resistance element and the shunting means. The palm itself may have tactile sensor along its surface or it may be without feeling.

A preferred method of sensing positional touch along a finger, or palm comprising contacting a shunting means extending along the finger or the palm and a resistance element extending along the finger at a position in which an object is encountered and touched by the finger and sensing positional information according to potential drop associated with a portion of the resistance element which remains uncensored after the encounter and touch, or multiple resistance elements located along the palm working as above to give area information, if desired along the palm.

An object of the present invention is the provision of a sensing apparatus comprising at least one elongated member extending from a base member, touch positional sensing means disposed along at least a substantial part of said elongated member, said sensing means comprising an elongated resistance element disposed along said elongated member and elongated shunting means disposed in a generally side-by-side relation with said resistance element with a gap therebetween, a source of electrical potential connected to the opposite ends of said resistance element and resistance sensing means connected to one end of said resistance element and to said shunting means for sensing the resistance of the resistance element between a given reference point or points on said resistance element and a point or points of contact between said resistance element and said shunting means along said position sensing means, whereby the relative position of said point or points of contact along said position sensing means can be determined.

Another object of the present invention is the provision of a sensing apparatus wherein said elongated member is shaped generally as a finger, or with multiple sensors as a finger or palm.

Yet another object of the present invention is the provision of a sensing apparatus further comprising an elongated insulator connected to each finger, the resistance element being mounted on the insulator and the resilient means comprising parallel elastomeric pads positioned beside the insulator and extending outward from the finger beyond the insulator and wherein the shunt means comprises a conductive strip connected to the elastomeric pads outward from the insulator and spaced from the resistance element and movable into contact with a portion of the resistance element by compression of a portion of the elastomeric pads by pressure placed upon the conductor strip.

A further object of the present invention is the provision of a sensing apparatus wherein the resistance element extends back and forth transversely across the supporting finger as it extends outward along the finger, with a series of substantially long transversely extending resistance portions interconnected at opposite ends thereof by relatively short longitudinally extending resistance portions, whereby as the shunt means contacts successive relatively long longitudinally extending portions of the resistance element the sensing means senses stepped changes in potential, thus digitizing the signal of the sensor means.

Still another object of the present invention is the provision of a sensing apparatus wherein the longitudinally extending portions of the resistance element become successively shorter as the resistance element proceeds from one end of the supporting finger or palm, to a second end of the supporting finger or palm, providing non linear sensing. This will permit extra sensation in special areas of the finger, or palm.

Another object of the present invention is the provision of a sensing apparatus wherein each finger is tapered with a relatively large first end connected to a palm and a relatively small second end spaced from a palm.

Yet another object of the present invention is the provision of a sensing apparatus wherein the transversely extending portions of the resistance element are substantially equal in length along the entire surface of the finger.

Still another object of the present invention is the provision of a sensing apparatus wherein one end of the shunt means is electrically connected to one end of the resistance means and wherein the sensing means is electrically connected to the other end of the resistance means and to the shunt means.

A further object of the present invention is the provision of a sensing apparatus wherein the sensing means is connected to one end of the shunt means and to one end of the resistance element.

Another object of the present invention is the provision of a sensing apparatus wherein the resilient means comprises an elongated elastomeric strip having a central portion for holding the resistance element and having upward extended lateral portions for holding the shunt means.

Yet another object of the present invention is the provision of a sensing apparatus wherein the elastomer strip further comprises a base portion and column portions extending upward on opposite sides of the resistance element for supporting the shunt means spaced from the resistance element until the shunt means encounters an obstacle.

Still another object of the present invention is the provision of a sensing apparatus wherein the elastomeric strip comprises block-like lateral portions surrounding a block-like central portion, wherein the resistance element is placed on the block-like central portion and wherein the shunt means comprises a conductor planar element supported on the block-like outer portions of the elastomeric strip.

A further object of the present invention is the provision of a sensing apparatus wherein the resistance element is grounded at opposite ends at where the source of potential is applied to one end of the shunt means and whereby the sensing means senses drop in potential according to position of grounding of the shunt means on the resistance element.

Another object of the present invention is the provision of a sensing apparatus further comprising second shunt means substantially parallel to the first shunt means, the second shunt means having potential applied upon to one end thereof which is possible to the end of the first shunt means on which potential is applied.

Still another object of the present invention is the provision of a sensing apparatus wherein the resistance element comprises a first resistance element having a potential applied at one end thereof and further comprising a second resistance element whereby the sensing means senses positional contact of the shunt means from opposite ends of the supporting finger.

A further object of the present invention is the provision of a sensing apparatus wherein the resistance element comprises a resistance strip longitudinally extended along the supporting finger, wherein the resilient means comprises first and second parallel elastomeric strips extending along opposite lateral edges of the resistance strip and wherein the shunt means comprises a flexible metal strip positioned on the elastomeric strips.

Another object of the present invention is the provision of a sensing apparatus wherein the flexible metal shunt strip comprises a comb-like strip, continuous along one lateral edge and discontinuous along the opposite lateral edge. This will soften the touch and digitize the data.

Yet another object of the present invention is the provision of a sensing apparatus wherein the resilient means is mounted above and below the resistance element and/or the shunt means comprises upper shunt means connected to the resilient means and lower shunt means connected to the resilient means on opposite sides of the resistance element whereby the sensing means senses positional contact of either shunt means or the resistance element on either side of the resistance element.

Still another object of the present invention is the provision of a sensing apparatus wherein the resistance element comprises a relatively rigid conductor and wherein the resilient means comprises a domed resilient strip connected to the rigid conductor and wherein the shunt means is mounted inside the domed resilient strip.

A further object of the present invention is the provision of a sensing apparatus comprising a palm mounted for movement, a finger mounted on the palm for movement with respect to the palm and touch positional sensing means mounted on at least one side of the finger for sensing position along the finger at which a relatively stationary object is encountered and touched by the finger and/or palm, the sensing means comprising a resistance element extending along the finger and a resistance along the palm, and a shunt means extending along the finger parallel to the resistance element and resilient means extending along the finger and spacing the shunt means and the resistance element similarly along the palm, until a relatively stationary object is encountered and touched and further comprising potential means connected to one of the resistance element and shunt means and potential sensing means connected to one of the resistance element and shunt means for sensing potential drop associated within a portion of the resistance element remaining unshunted after contact of the resistance element and the shunting means, by either the finger or palm or both.

Another object of the present invention is the method of sensing positional touch along a finger comprising contacting a shunting means extending along the finger and a resistance element extending along the finger at a position in which an object is encountered and touched by the finger and sensing positional information according to potential drop associated with a portion of the resistance element which remains uncensored after the encounter and touch.

Yet another object of the present invention is the method further comprising contacting an object with several fingers, sensing tactile positional information along the several fingers and comparing the sensed information with stored information.

Still a further object of the present invention is the inclusion of force sensors and temperature sensors of standard commercial availability to give the touch position sensor thermal and force feedback signals for recognition of position, heat and force or weight information.

Yet another object of this invention is to give the palm area multiple sensors to be able to sense an object's "foot print" on the palm surface.

A further object of this invention is to give the sensing finger complete elasticity so that a tentical or non rigid wrap around finger sensing continuous contoured surfaces.

Still another object of this invention is the provision of the sensing means which is placed in an array defining a tactile area to be used as touch surface for determining position and alignment of an object or objects brought into contact with it.

These and further and other objects and features of the invention are apparent in the disclosure which includes the above and ongoing specification and claims and the drawings.

DETAILED DESCRIPTION OF THE DRAWINGS

Figure 1:
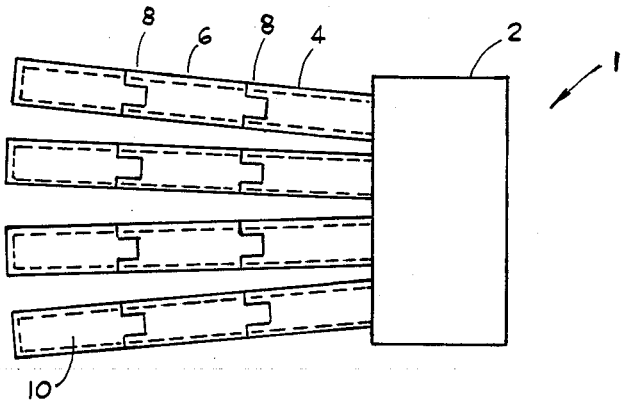
FIG. 1 is a schematic representation of the hand having plural fingers, on one side of a palm.
Figure 2:
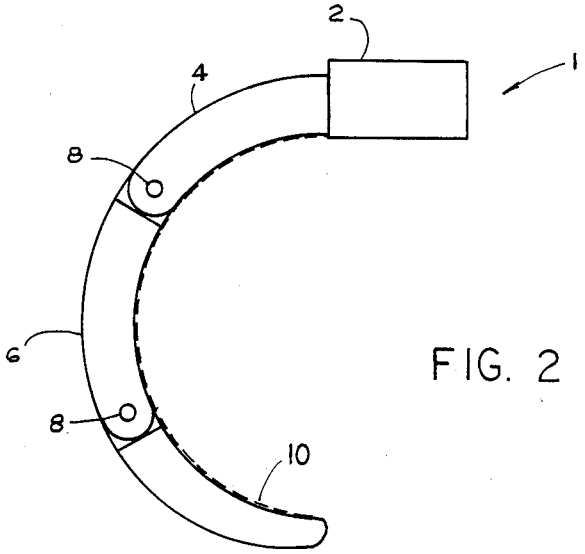
FIG. 2 is a schematic detail of the hand shown in FIG. 1. Elements of the surface of 4 can be curved as shown or flat.

Referring to FIG. 1, an intelligent hand is generally indicated by the numeral 1. The hand has a palm 2 and finger 4 attached to the palm. Each of the fingers has segments 6 which are articulated to each other and to the palm by hinges 8. Elongated sensing elements generally indicated by the numeral 10 are positioned on the fingers. One sensing element is positioned on each supporting finger. The sensing elements 10 indicate what portion or portions of what finger are being contacted by an object which is encountered by the fingers. Multiple jointed fingers can approach the function of a tentacle.

Figure 3:
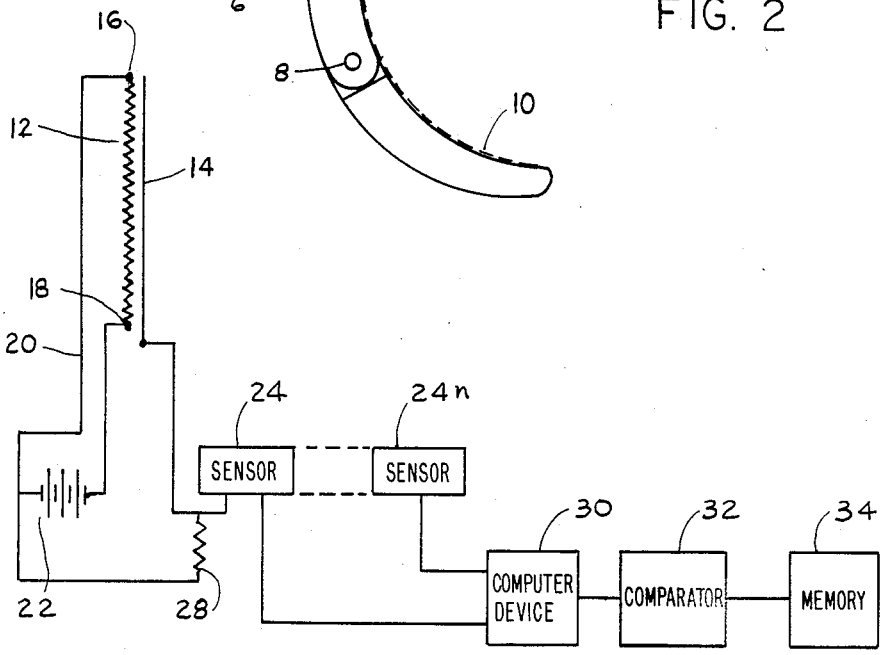
FIG. 3 is a schematic detail of the sensing and comparing means.

One form of the sensing means 10 is schematically shown in FIG. 3. The preferred sensing means 10 comprises a resistance element 12 which may be any form of an appropriate resistor element such as a round or flat or other shape of wire in a straight, sinuous, curved, rectangular or coiled or other relationship.

The shunt means 14 may take any form, such as a flat, flexible conductive plate or a round or plate wire, a comb-like cutout plate in which the teeth of the comb-like element may be pressed against the resistance element or any other form of conductor which may be placed parallel to the resistance element. Preferably the shunt 14 is supported spaced from the resistance element 12 so that only a portion of the shunt means 14 or the resistance element 12 may be moved into contact with the other.

As shown in the example of FIG. 3, opposite ends 16 and 18 of the resistance element 12 are connected by leads 20 to a source of potential 22, which may be a battery, a recitifier, a transformer, line voltage or any other source of electrical potential.

A sensor 24 is connected to one end 26 of the shunt 14. The sensor may be any convenient sensor which may sense resistance in all or a portion of the resistance element 12 or which may sense potential drop across a shunt resistance 28 or potential drop across a portion of resistance element 12. Plural sensors 24 connected to plural sensors 10 on plural fingers 4 may be connected to a computer device 30 which is in turn connected to comparator 32 and memory 34 to recognize predetermined patterns of contact, indicating that an object is touched correctly or incorrectly or indicating what type of an object is touched by the fingers 4 of hand 1.

Figure 5:
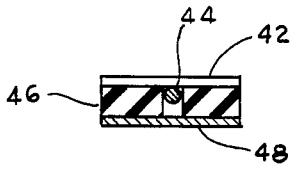
FIG. 5 is a cross section of the finger shown in FIG. 4 taken along line 5—5.
Figure 4:
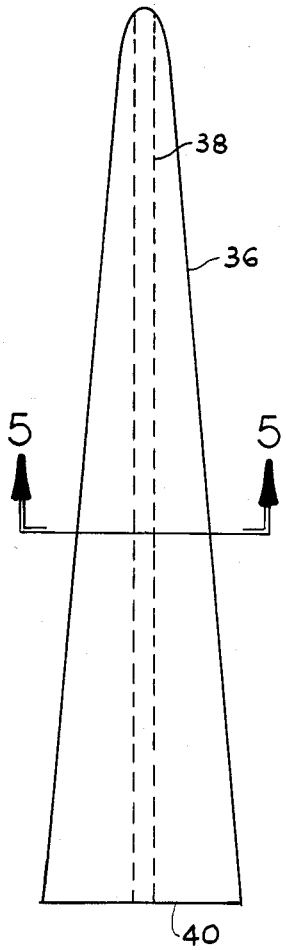
FIG. 4 is detail of a preferred finger.

As shown in FIGS. 4 and 5, a finger 36 having a sensor 38 has a base 40, a back insulator 42, a resistance element 44 positioned on the back insulator, and form rubber or elastomeric pads 46 positioned on the back insulator on opposite sides of the resistance element 44. A thin, flexible conductive strip 48 is mounted on top of the elastomeric pads 46. When the finger 36 touches an element, the conductive strip 48 is pressed against a portion of the resistance element 44. Pushing on the surface 48 causes the sandwich to compress locally. The compression forms a potentiometer. Position is then proportional to resistance.

Figure 6:
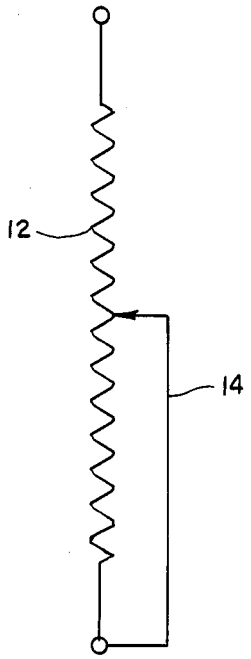
FIG. 6 is a schematic detail of one type of sensor.

FIG. 6 shows an ohmic edge effect device. Contact of the shunt 14 on the resistance element 12 reduces the remaining resistance which is measured to determine the position of touch.

Figure 7:
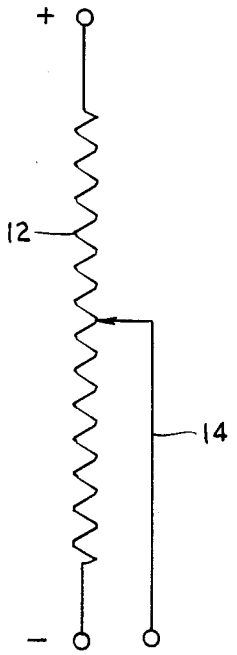
FIG. 7 is a schematic detail of another type of sensor.

FIG. 7 shows a resistance element 12 to which a standard source of potential has been conducted. The potential on shunt 14 is measured to indicate position of touch.

Figure 8:
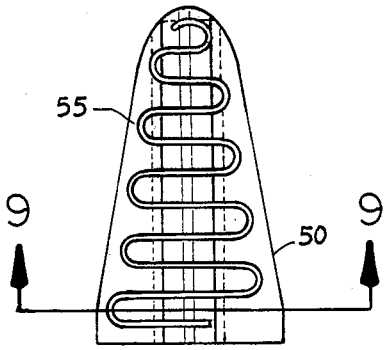
FIG. 8 is a drawing on one proposed embodiment.
Figure 9:
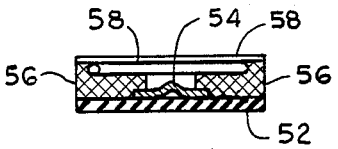
FIG. 9 is a cross section of the embodiment shown in FIG. 8 taken along 9—9.

FIGS. 8 and 9 show a tapered finger 50 with a base 52 which supports a serpentine resistance element 54, or an inversion serpentine shunt 54. Upward extending edges 56 of a foam elastomer hold the resistor serpentine 54, or in the inversion serpentine conductor 59, which is forced into contact upon touching an object through a thin, insulating film 58 along one of the longitudinally extended transverse sections of resistor 55 with shunt element 54 by compressing the soft foam insulating elastomer 56, cemented to base 52. Because a substantial length of the resistance element exists between the shunt contact areas for the serpentine resistance 55, a stepped or digital non linear resistance or potential change is noted upon positional change of the object touched by the finger. This technique can increase touch sensitivity in a region of the finger. The inversion where the serpentine 55 is the shunt and 54 the resistance produces a "soft touch" linear digital finger. The number of digits is based on the number of convolutions to serpentine 55.

Figure 10:
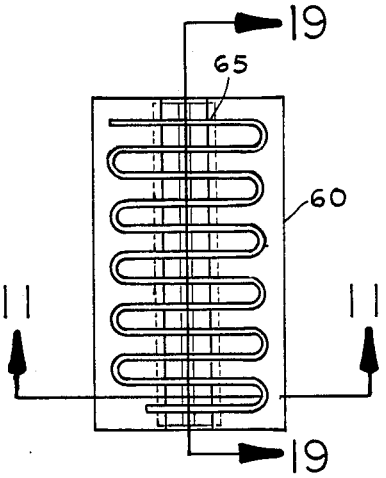
FIG. 10 is a detail of another embodiment of the invention.
Figure 11:
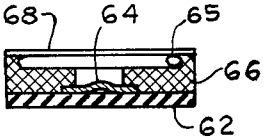
FIG. 11 is a cross sectional detail of the finger shown in FIG. 10 taken along line 11—11 of FIG. 10.

In another embodiment of the invention, as shown in FIGS. 10 and 11, a rectangular finger 60 has a base 62 with a central opening to receive conductive shunt element 64. Upward extending sides 66 made of a foam elastomer cemented to the base 62 hold the curved resitance strip 65. Upon encountering an object and touching an object with the shunt strip through thin film 68. The resistance 65 is pressed toward the shunt element 64 to shunt part of the resistance and produce a change in resistance or potential which is related to the position along finger 60 at which the object is touched. This is a linear digital touch position sensor with enhanced resistance change per convolution. The voltage or resistance variation is based on the resistance of the overall length of resistor 65 and the number of convolutions.

Figure 12:
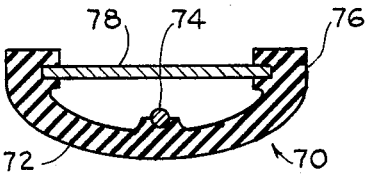
FIG. 12 is a cross sectional detail of an alternate sensor embodiment.
Figure 13:
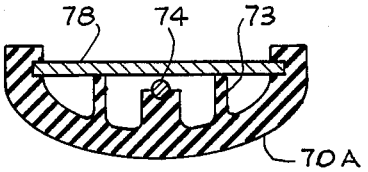
FIG. 13 is a cross sectional detail of an alternate sensor embodiment.

Another modified device is shown in FIG. 12. The finger 70 has a curved elastic base 72 with a raised central portion which holds resistance element 74. Raised ends 76 of the curved elastic base 72 hold the rigid shunt 78 so that it may contact a portion of the resistance element 74 when pressing curved section 72, holding resistance 79 toward shunt 78. A similar embodiment 70A is shown in FIG. 13 in which flexible columns 73 hold the shunt 78 away from the resistance element 74. This allows a smaller movement of the curved surface to contact the rigid shunt 78. Space is controlled by the geometry of the columns and the spacing of resistor 74.

Figure 14:
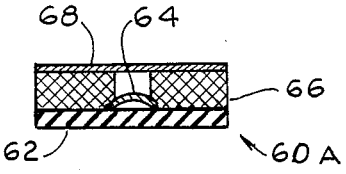
FIG. 14 is a cross sectional detail of an alternate sensor embodiment.

FIG. 14 shows a modification 60A in which the insulating base 62 supports an arched resistance strip 64. Flat outer resilient blocks 66 supports a flat flexible shunt plate 68 which compresses resilient block 66 when touched and contacts resistance element 64 at a point. This contact is indicated electrically by a potential or resistance porportional to the position.

FIGS. 15–18 show modifications of the devices shown in FIGS. 3, 6 and 7.

Figure 15:
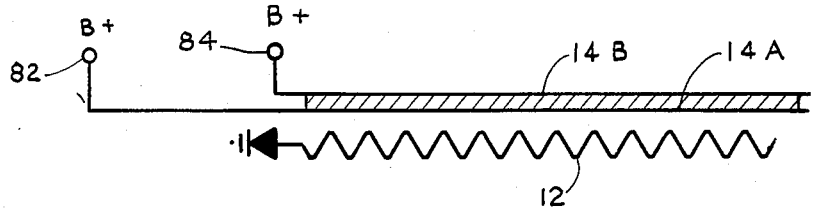
FIG. 15 is a schematic representation of one form of resistance element and shunt, containing a force sensor (i.e., piezzo electric film or substrate). This information rides over the top of the B+ signal.

In FIG. 15 a resistance element 12 is grounded. Shunts 14A and 14B have potentials applied to their ends 82 and 84, and form a sandwich encasing a piezo electric substrate.

When the sandwich is pressed against resistance element 12 or when the resistance element 12 is pressed against the sandwich shunts, current flow or voltage drop indicates the position of touching and a signal riding on the supply indicates applied force.

Figure 16:
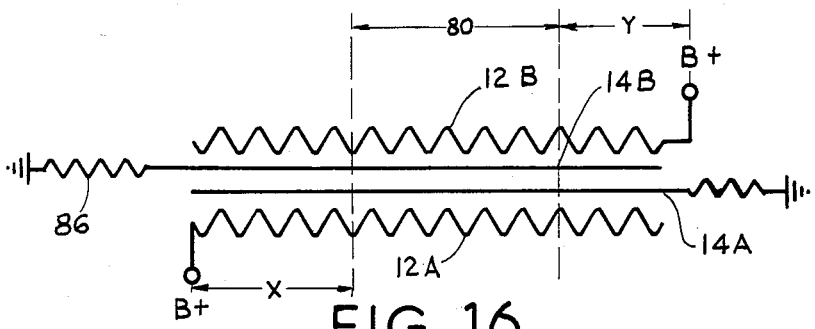
FIG. 16 is a schematic representation of one form of detail shown sensing from the top and bottom of a finger.
Figure 17:
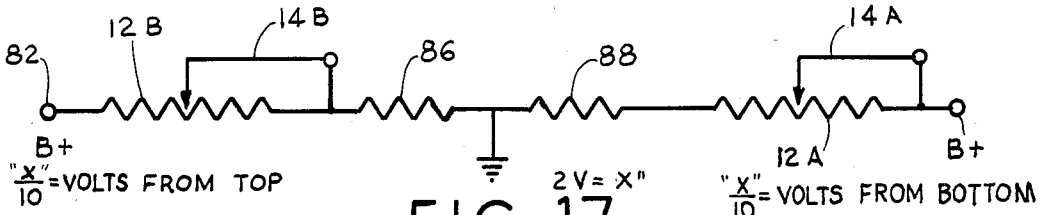
FIG. 17 is a schematic representation of the circuits of the apparatus shown in FIG. 16.

In FIGS. 16 and 17 two resistance elements 12A and 12B are provided at opposite ends with potentials and parallel shunts 14A and 14B are grounded at opposite ends. An area of contact generally indicated by the numeral 80 presses shunt 14A and resistance element 12A together and shunt 14B and resistance element 12B together, producing separate indications or distance from the top and distance from the bottom.

As shown in FIG. 17, ten volt potentials for example are connected at opposite ends 82 and 84 of resistance elements 12A and 12B. Resistances 86 and 88 connected in series to the resistant elements can, provided fixed offsets or current limiting two independing voltages are generated for each finger "X" and "Y" voltages, show distances from the top and from the bottom, respectively. This difference therefor can be used to show area of contact.

Figure 18:
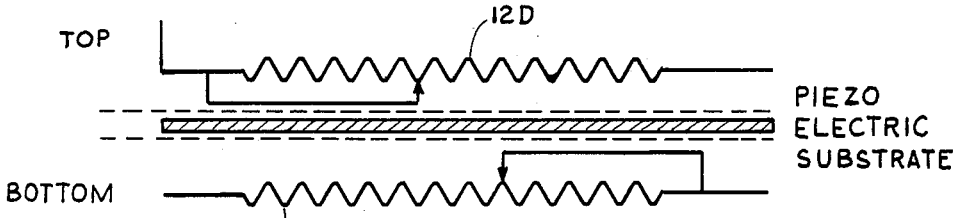
FIG. 18 is an alternative form of area sensor showing resistance elements 12*c* and 12*d* which give indication of touch distances for the top and bottom, and including a force sensing element or substrate.
Figure 19:
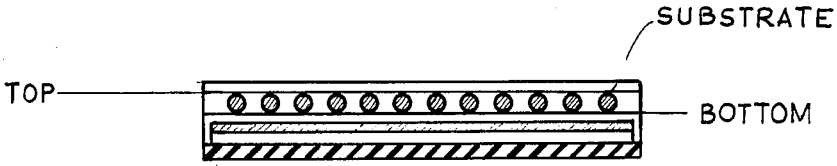
FIG. 19 is a cross section of a finger of FIG. 10 taken along line 19—19 showing sensing from the top and bottom of a finger.

The construction shown in FIGS. 16, 17, 18 and 19 may be used to show distances from the top and bottom and thus area of contact. FIG. 18 shows the inclusion of a piezzoelectric sheet between sensing elements or between the shunt and resistance element. The addition of a piezzoelectric sheet will add force or pressure sensing capability to the finger. FIG. 19 is a cross section along a serpentine resistance finger similar to FIG. 10 but with top and bottom area sensing.

Figure 20:
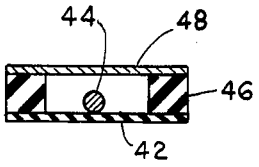
FIGS. 20-24 are cross sectional details of form of sensors.

FIGS. 20–24 show different forms of sensing devices. The system shown in FIG. 20 is similar to the system shown in FIG. 5, with the exception that the resistance element 44 is bonded to the center of the insulator 42. Resilient elongated blocks 46 are bonded to the insulator 42 and to edges of the flexible metallic strip shunt 48.

Figure 21:
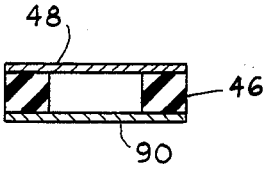

The construction shown in FIG. 21 is similar except the resistance strip is formed of a flat, flexible resistance plate 90.

Figure 22:
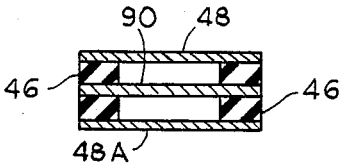

The construction shown in FIG. 22 is similar except that the resistance strip 90 has resilient blocks 46 mounted on opposite surfaces thereof and an additional flexible shunt strip 48 is provided to provide bottom up measurements when the top strip 48 provides top down measurements.

Figure 23:
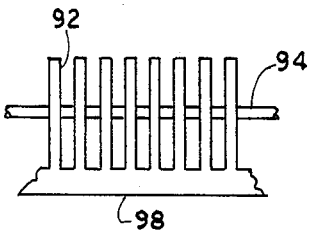

An alternative form of flexible shunt is shown in FIG. 23. A comb like flexible shunt 98 supported by any of the means previously described is pulsed into contact with resistance element 94. This is a very soft touch linear digital position sensor. Spacing of the comb like extension 92 can be varied to get different stiffness and different digital sensitivity.

Figure 24:
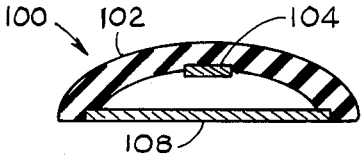

As shown in FIG. 24, a finger 100 is constructed of a base 102 which supports a rectangular or round flexible conductive resistance element 104 above a rigid conductor shunt 108. When the elastomeric support 102 contacts an object, a portion of the flexible resistance element 104 is moved into contact with the rigid conductor shunt 108.

Figure 25:
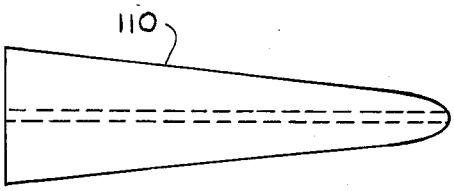
FIG. 25 is a detail of a tapered finger.
Figure 26:
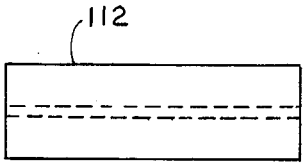
FIG. 26 is a detail of a straight finger.

FIGS. 25 and 26 show that each of the devices may be embodied in a tapered finger 110 or in a rectangular finger 112.

Figure 27:
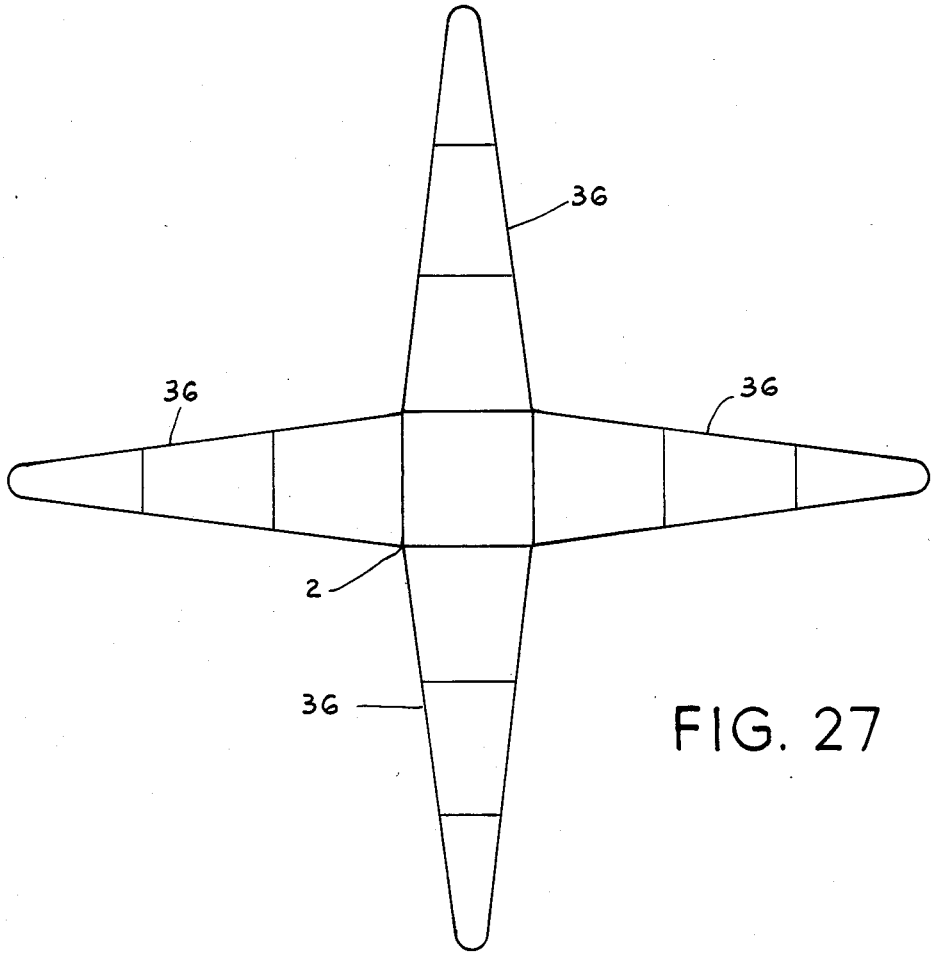
FIG. 27 shows a device where the fingers 36 can be in opposition. Grasped objects will be held between the fingers 36 or by fingers 36 against the palm 2.

Opposed fingers are shown in FIG. 27. Any number of opposed fingers on opposed sides (2, 4, 6, 8, etc.) may be used. Four fingers 36 are shown.

Figure 28:
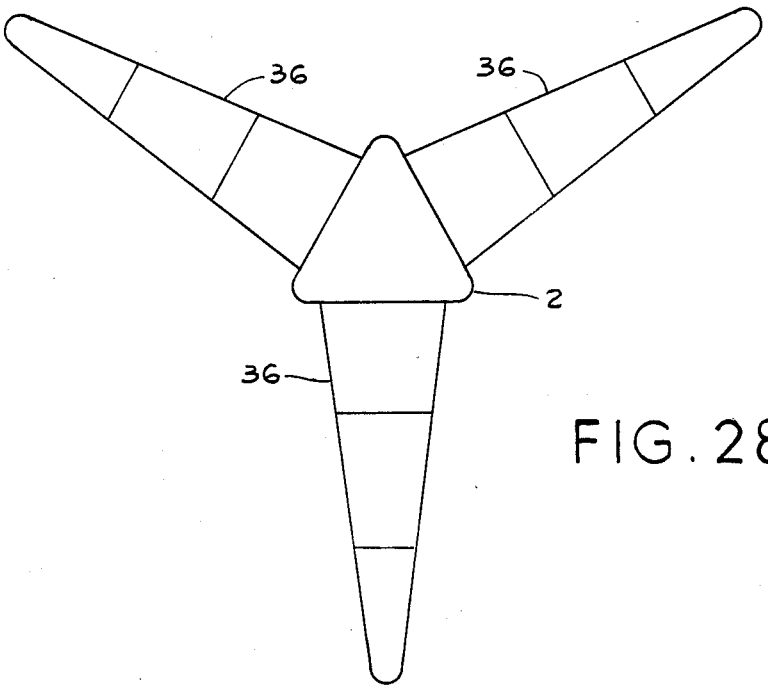
FIG. 28 shows inerleaved fingers 36. The object grasped is pushed into the palm 2. Said palm can be touch sensitive with a grid of sensors or unfeeling depending on system requirements.

Interlaced fingers are shown in FIG. 28. The fingers 36 clear one another and clamp against the palm 2. Any number of interlaced fingers on sides (3, 5, 7, 9, etc.) may be used. Three fingers are shown. Interlaced fingers can wrap around an object smaller than finger length. The fingers will not interfere with one another.

Figure 29:
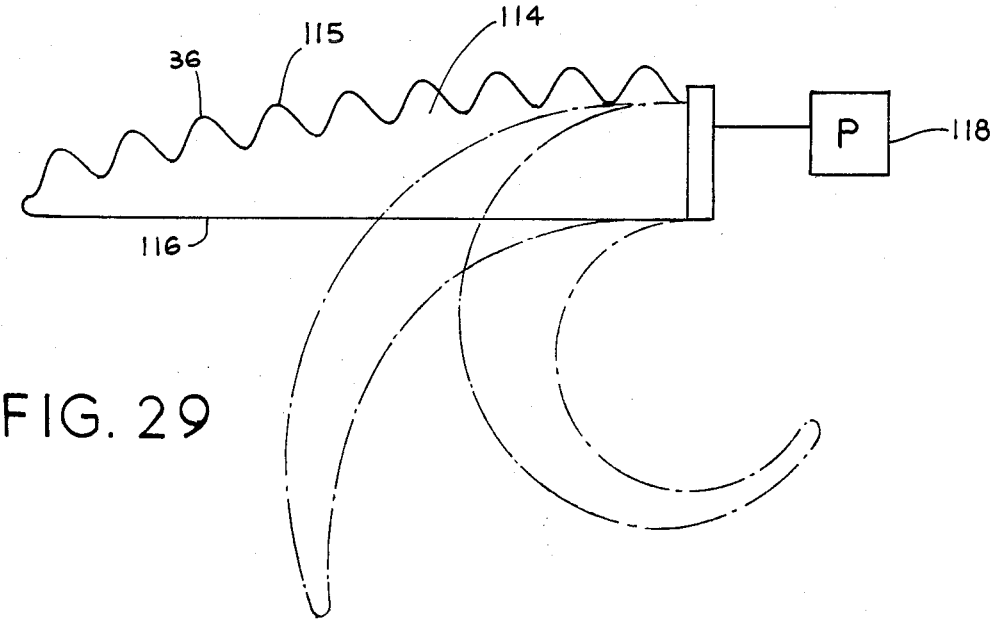
FIG. 29 shows a completely flexible finger that can be wrapped around objects.

FIG. 29 shows a finger with a completely flexible surface 116 that can curl around an object. A pressure from a hydraulic or pneumatic source 118 straightens the finger 114. Finger 114 has an expandible back and a flexible tactile surface 116, consisting of a flexible resitance, flexible shunt, and compressible spacers.

Figure 30:
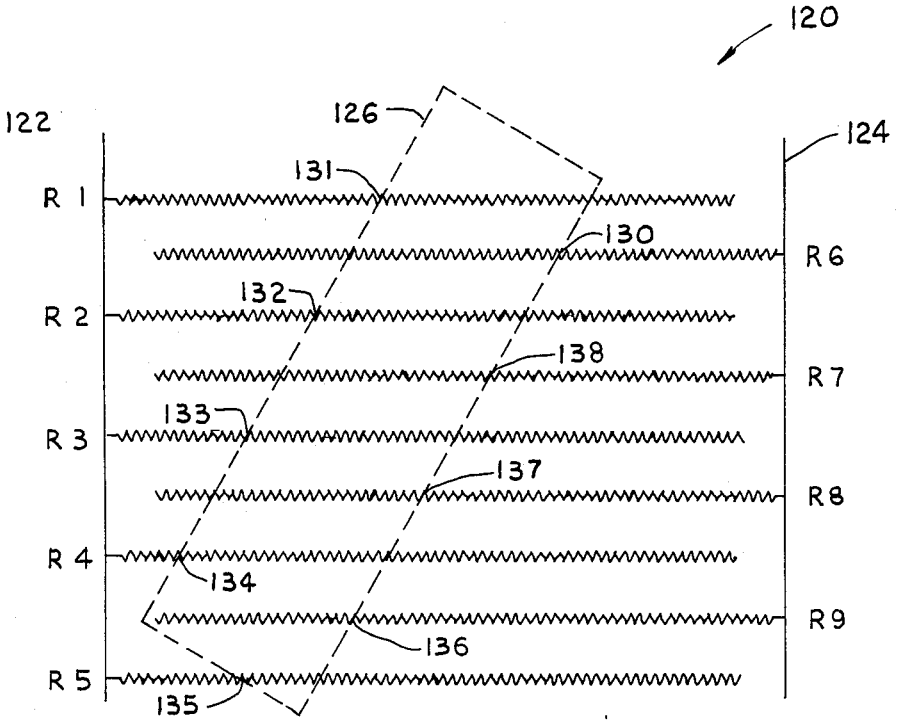
FIG. 30 shows a palm that uses the touch potentiometer concept for sensing the edges of an area of contact.

As shown in FIG. 30, a grid system 120 is suitable for mounting on a palm 2. By touching the palm in the region between buss 122 and buss 124 resistance information is fed by each touch resistor into a corresponding shunt, above or below the resistor. For example, resistor R1 senses object 126 contact from the left at position 131 and R6 senses contact of the object from the right at position 130 and so on. Points of contact 130 through 138 give information on alignment, shape and area. Increase or decrease in sensitivity to shape is obtained by increasing or decreasing the number of resistor elements. Using the touch resistor concept in linear or other arrays gives the palm the ability to sense patterns against stored references for alignment of fingers.

While the invention has been described with reference to specific embodiments, modifications and variations may be made without departing from the scope of the invention. The scope of the invention is defined in the following claims.

What is claimed is:

1. A sensing apparatus comprising at least one elongated member extending from a base member, touch positional sensing means disposed along at least a substantial part of said elongated member, said sensing means comprising an elongated resistance element disposed along said elongated member and elongated shunting means disposed in a generally side-by-side relation with said resistance element with a gap therebetween, a source of electrical potential connected at least one end of said resistance element, and resistance sensing means connected to one end of said resistance element and to said shunting means for sensing the resistance of the resistance element between a given reference point or points on said resistance element and a point or points of contact between said resistance element and said shunting means along said position sensing means, whereby the relative position of said point or points of contact along said position sensing means can be determined.

2. The apparatus of claim 1 wherein said elongated member is shaped generally as a finger.

3. The apparatus of claim 2 further comprising an elongated insulator connected to each finger, the resistance element being mounted on the insulator and the resilient means comprising parallel elastomeric pads positioned beside the insulator and extending outward from the finger beyond the insulator and wherein the shunt means comprises a conductive strip connected to the elastomeric pads outward from the insulator and spaced from the resistance element and moveable into contact with a portion of the resistance element by compression of a portion of the elastomeric pads by pressure placed upon the conductor strip.

4. The apparatus of claim 2 wherein the resistance element extends back and forth transversely across the supporting finger as it extends outward along the finger, with a series of substantially long transversely extending resistance portions interconnected at opposite ends thereof by relatively short longitudinally extending resistance portions, whereby as the shunt means contacts successive relatively long longitudinally extending portions of the resistance element the sensing means senses stepped changes in potential, thus digitizing the signal of the sensor means.

5. The apparatus of claim 4 wherein the longitudinally extending portions of the resistance element become successively shorter as the resistance element proceeds from one end of the supporting finger to a second end of the supporting finger.

6. The apparatus of claim 4 wherein each finger is tapered with a relatively large first end connected to a palm and a relatively small second end spaced from a palm.

7. The apparatus of claim 4 wherein the transversely extending portions of the resistance element are substantially equal in length along the entire surface of the finger.

8. The apparatus of claim 2 wherein one end of the shunt means is electrically connected to one end of the resistance means and wherein the sensing means is electrically connected to the other end of the resistance means and to the shunt means.

9. The apparatus of claim 2 wherein the sensing means is connected to one end of the shunt means and to one end of the resistance element.

10. The apparatus of claim 2 wherein the resilient means comprises an elongated elastomeric strip having a central portion for holding the resistance element and having upward extended lateral portions for holding the shunt means.

11. The apparatus of claim 10 wherein the elastomeric strip further comprises a base portion and column portions extending upward on opposite sides of the resistance element for supporting the shunt means spaced from the resistance element until the shunt means encounters an obstacle.

12. The apparatus of claim 10 wherein the elastomeric strip comprises block-like lateral portions surrounding a block-like central portion, wherein the resistance element is placed on the block-like central portion and wherein the shunt means comprises a conductor planar element supported on the block-like outer portions of the elastomeric strip.

13. The apparatus of claim 2 wherein the resistance element is grounded at opposite ends at where the source of potential is applied to one end of the shunt means and whereby the sensing means senses drop in potential according to position of grounding of the shunt means on the resistance element.

14. The apparatus of claim 13 further comprising second shunt means substantially parallel to the first shunt means, the second shunt means having potential applied upon to one end thereof which is possible to the end of the first shunt means on which potential is applied.

15. The apparatus of claim 2 wherein the resistance element comprises a first resistance element having a potential applied at one end thereof and further comprising a second resistance element whereby the sensing means senses positional contact of the shunt means from opposite ends of the supporting finger.

16. The apparatus of claim 2 wherein the resistance element comprises a resistance strip longitudinally extended along the supporting finger, wherein the resilient means comprises first and second parallel elastomeric strips extending along opposite lateral edges of the resistance strip and wherein the shunt means comprises a flexible metal strip positioned on the elastomeric strips.

17. The apparatus of claim 16 wherein the flexible metal shunt strip comprises a comb-like strip, continuous along one lateral edge and discontinuous along the opposite lateral edge.

18. The apparatus of claim 2 wherein the resilient means is mounted above and below the resistance element and/or the shunt means comprises upper shunt means connected to the resilient means and lower shunt means connected to the resilient means on opposite sides of the resistance element whereby the sensing means senses positional contact of either shunt means or the resistance element on either side of the resistance element.

19. The apparatus of claim 1 wherein the resistance element comprises a relatively rigid conductor and wherein the resilient means comprises a domed resilient strip connected to the rigid conductor and wherein the shunt means is mounted inside the domed resilient strip.

20. The apparatus of claim 1 further comprising a palm connected to the base member and a grid of touch sensors, on the palm, whereby the grid on the palm is an area touch sensor.

21. The apparatus of claim 2 wherein the finger is totally elastic whereby the finger bends along its surface and further comprising a pressure actuator means for operating the finger in a tenticular manner.

22. The apparatus of claim 1 wherein said sensing means is placed in an array defining a tactile area to be used as touch surface for determining position and alignment of an object or objects brought into contact with it.

23. Touch position sensing finger apparatus comprising a palm mounted for movement, a finger mounted on the palm for movement with respect to the palm and touch positional sensing means mounted on at least one side of the finger for sensing position along the finger at which a relatively stationary object is encountered and touched by the finger, the sensing means comprising a resistance element extending along the finger and a shunt means extending along the finger parallel to the resistance element and resilient means extending along the finger and spacing the shunt means and the resistance element until a relatively stationary object is encountered and touched and further comprising potential means connected to one of the resistance element and shunt means and potential sensing means connected to one of the resistance element and shunt means for sensing potential drop associated within a portion of the resistance element remaining unshunted after contact of the resistance element and the shunting means.

* * * * *